United States Patent [19]

Cook et al.

[11] 4,155,061

[45] May 15, 1979

[54] INDUCTOR CASING

[75] Inventors: Tony C. Cook; Robert H. Rhodes, both of London, England

[73] Assignee: Thorn Electrical Industries Limited, London, England

[21] Appl. No.: 854,177

[22] Filed: Nov. 23, 1977

[30] Foreign Application Priority Data

Nov. 25, 1976 [GB] United Kingdom ..... 49265/76

[51] Int. Cl.[2] ..... H01F 15/02; H01F 27/02; H01F 41/00

[52] U.S. Cl. ..... 336/65; 29/602 R; 336/90; 336/210

[58] Field of Search ..... 336/90, 92, 98, 210, 336/65, 192; 174/DIG. 2; 29/602 R, 606

[56] References Cited

FOREIGN PATENT DOCUMENTS

| | | | |
|---|---|---|---|
| 249118 | 5/1963 | Australia | 336/210 |
| 1021360 | 3/1966 | United Kingdom | 336/210 |
| 1416356 | 3/1975 | United Kingdom | 336/210 |

*Primary Examiner*—Thomas J. Kozma

*Attorney, Agent, or Firm*—Dike, Bronstein, Roberts, Cushman & Pfund

[57] ABSTRACT

An inductor such as a fluorescent lamp choke comprises a bobbin carrying a winding, a laminated core, and a sheet metal casing consisting of two parts which have interengaging flanges and grooves along four parallel edges which are slid together and subsequently bent over and pressed against end faces of the core to secure the parts of the casing together so that they exert pressure on the core from all sides.

8 Claims, 3 Drawing Figures

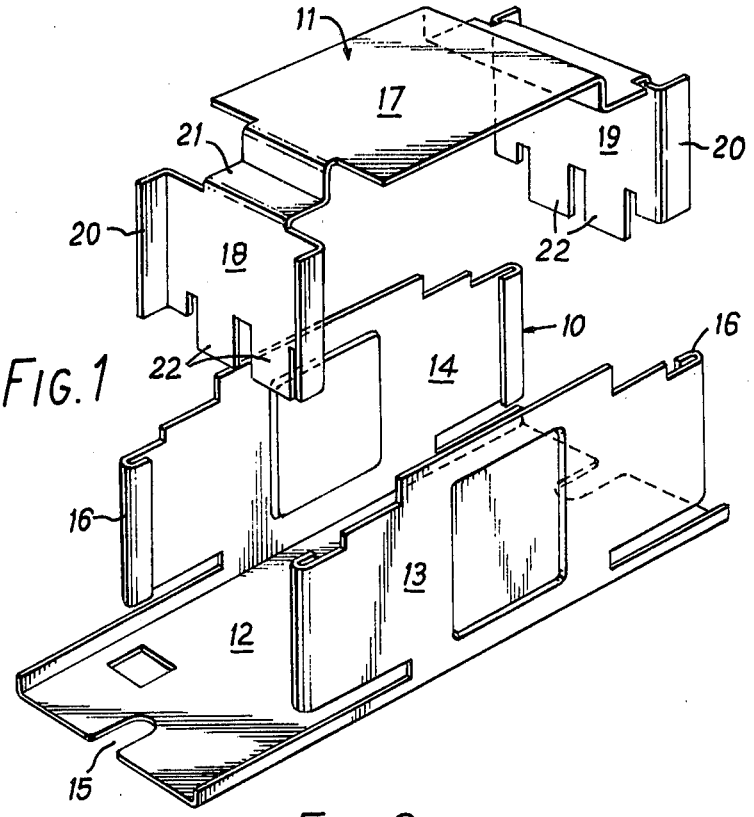
FIG. 1
FIG. 2
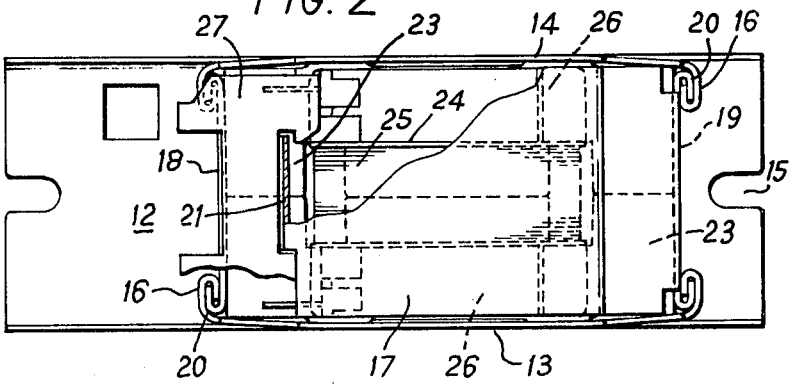
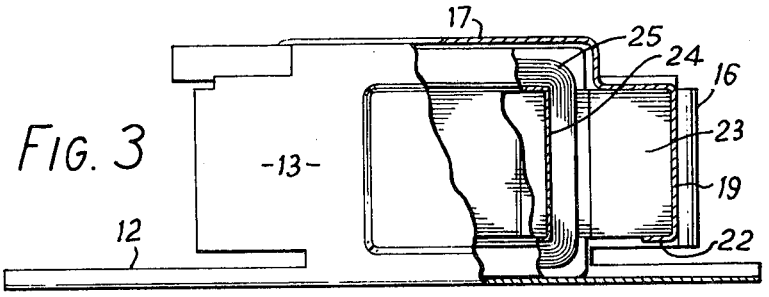
FIG. 3

INDUCTOR CASING

The present invention relates to a casing for an inductor such as a fluorescent-lamp choke.

Casings at present used for fluorescent-lamp chokes and other inductors are assembled by welding or using fasteners such as screws or rivets. These casings often do not clamp tight onto the inductor, which can lead to inefficient cooling of the inductor and excessive vibration and noise.

According to the present invention there is provided a method of assembling an inductor which comprises a core carrying a winding and enclosed in a sheet metal casing wherein the casing is formed in two parts each of which comprises two opposite walls of the casing and a third wall joining the two opposite walls, the side edges of the two opposite walls of each part are shaped to slidingly interengage with the side edges of the two opposite walls of the other part, the two parts are assembled around the core by sliding engagement of the said side edges and the said side edges are thereafter deformed to clamp the two parts together. As a result of this method of assembly the two parts of the casing are thus clamped one to the other along four parallel edges of the casing where the side edges of the two parts have been interengaged.

The invention also provides inductors made by this method and in particular an inductor comprising a core carrying a winding and enclosed within a sheet metal casing, wherein the casing comprises two parts each of which forms two opposite walls of the casing and a third wall joining them together, the side edges of the said opposite walls of the two parts having members which have been slidingly interengaged upon assembly of the casing and thereafter deformed to clamp the two parts together.

The said members at the side edges may comprise, for each edge of the casing where the side edges of the two parts interengage, a flange on one side edge and a receiving fold on the other side edge. Once the flange has been slidingly interengaged with the fold the resultant seam is compressed or otherwise deformed. With flange-and-fold members it is preferred that the fold extends inwardly of the wall on which it is located, and that correspondingly the flange extends outwardly of its wall.

Preferably the third wall of one of the parts extends beyond the opposite walls of the other part to form projecting lugs for mounting of the inductor on a support. Such a construction is especially useful when the inductor is a fluorescent lamp choke, the lugs then serving for mounting of the inductor on the spine of the lamp.

The invention will be described in more detail with the aid of an example illustrated in the accompanying drawing, in which:

FIG. 1 is a perspective view of the two parts of a casing for a fluorescent lamp choke in accordance with the invention prior to assembly, FIG. 2 is a plan view of the choke after assembly with parts of the casing cut away, and FIG. 3 is a side elevation of the choke after assembly, again with parts cut away.

The casing shown in the drawings is made from sheet steel and comprises two channel-shaped parts 10 and 11 which can be press-fitted together around an inductor so as to enclose the inductor on all six sides, the parts being held together along four side edges.

The part 10 comprises a plate 12 and two opposite side walls 13 and 14. The plate 12 extends beyond the edges of the side walls 13 and 14 to form attachment lugs with slots 15 for attachment of the casing to the spine of a fluorescent lamp fitting. Each of the side walls 13 and 14 has its parallel side edge portions 16 folded back inwardly onto themselves to form hooks or clips. The clips, being formed inwardly, do not extend outside the width of the plate 12.

The part 11 comprises a plate 17 and two opposite end walls 18 and 19. This part is dimensioned to fit in between the side walls 13 and 14 and each end wall 18, 19 has its parallel side edges 20 folded back outwardly onto themselves to form flanges which can slidably engage into the hooks or clips formed on the side walls 13 and 14. The plate 17 and the free edges of the side walls 13 and 14 are correspondingly stepped to match the shape of the core and winding which is to be enclosed by the casing. Cut-outs are formed at one end of the plate 17 so that a relatively narrow connecting strip 21 serves to attach the plate 17 to the side wall 18. The free edges of the side walls 18 and 19 are each formed with a pair of tabs 22.

The parts 10 and 11 of the casing are fitted around a core comprising two stacks of E-shaped laminations 23, a bobbin 24, and a winding 25. The bobbin 24 which supports the winding 25 also has flanges 26 which define the upper and lower ends of the stacks of laminations. For assembly of the inductor the part 11 of the casing is first fitted over the inductor unit formed by the laminations 23, the bobbin 24, and the winding 25. The tabs 22 are turned inwards as seen in FIG. 3 to embrace the ends of the stacks of laminations, the provision of two tabs at each end allowing for any difference in height of the two stacks of laminations. The part 10 of the casing is then fitted by sliding the flanges 20 and the hooks or clips formed by the edge portions 16 into engagement and pressing the two parts together. The edge portions 16 are then folded round towards the end walls 18 and 19 and a compressive axial force is applied to the interengaged hooks and flanges to clamp them together onto the end walls as shown in FIG. 2.

The clamping action forces the inductor laminations together in an axial direction and the folding round of the edge portions 16 engages the corners of the lamination stack at each end of the inductor to provide a compressive force across the axial direction. A compressive force in a third direction is provided by the tabs 22 and by the parts being pressed firmly together before clamping. Thus the inductor unit is held in compression along all three axes at once which reduces vibration and noise. The casing is in intimate contact with the inductor unit on all six faces so that good thermal conduction is obtained to transfer heat from the coil and magnetic core.

A snap-on terminal board 27 engages the connecting strip 21 and carries terminals which are connected to the winding 25.

We claim:

1. An inductor comprising a core carrying a winding and enclosed within a sheet metal casing of rectangular, box-like form, wherein the casing comprises two parts each of which forms two opposite walls of the casing and a third wall joining them together, the side edges of the said opposite walls of the two parts having members which have been slidingly interengaged upon assembly of the casing and thereafter deformed to clamp the two parts together.

2. An inductor as claimed in claim 1 wherein the said members at the side edges comprise fold members on one part turned inwards with respect to the wall to which they are attached and flange members on the other part turned outwards with respect to the wall to which they are attached and embraced by the fold members of the said one part.

3. An inductor as claimed in claim 1 in which the opposite walls of one part have tabs at their free edges which have been turned into embrace the ends of the core.

4. An inductor as claimed in any of claim 1 in which the third wall of one of the parts extends beyond the opposite walls of the other part to form projecting lugs for mounting of the inductor on a support.

5. An inductor as claimed in any of claim 1 in which the third wall of one part is attached to one of the opposite walls by a relatively narrow connecting strip on which a terminal board for the winding is mounted.

6. A method of assembling an inductor comprising forming a sheet metal casing in two parts, each of which comprises two opposite walls of a rectangular, box-like casing and a third wall joining the two opposite walls, with the side edges of the two opposite walls of each part shaped to slidingly interengage with the side edges of the two opposite walls of the other part, assembling said two parts around a core carrying a winding by slidingly interengaging said side edges and thereafter deforming said side edges to clamp said two parts together.

7. A method of assembling an inductor which comprises a core carrying a winding and enclosed in a sheet metal casing wherein the casing is formed in two parts, each of which comprises two opposite walls of the casing and a third wall joining the two opposite walls, said edges of the two opposite walls of each part being shaped to slidingly interengage with the side edges of the two opposite walls of the other part and one of the parts having tabs at the free edges of the two opposite walls, bending the tabs at the free edges of the two opposite walls into engagement with the ends of the core, assembling the two parts around the core by sliding engagement of said side edges and thereafter deforming the side edges to clamp the two parts together.

8. A method of assembling an inductor which comprises a core carrying a winding and enclosed in a sheet metal casing wherein the casing is formed in two parts, each of which comprises two opposite walls of the casing and a third wall joining the two opposite walls and wherein one part has the said side edges bent outwards away from the opposite wall to form flanges and the other part bent over toward the inner face of the wall to which they are attached to define grooves, slidingly engaging the grooves and flanges and then bending the flanges together with the parts defining the grooves over against the outer faces of the opposite walls of said one part to effect clamping.

* * * * *